United States Patent [19]

Vogtmann et al.

[11] 4,213,434

[45] Jul. 22, 1980

[54] FUEL INJECTION SYSTEM

[75] Inventors: Hans-Jörg Vogtmann, Markgröningen; Gerhard Stumpp, Stuttgart, both of Fed. Rep. of Germany

[73] Assignee: Robert Bosch GmbH, Stuttgart, Fed. Rep. of Germany

[21] Appl. No.: 952,353

[22] Filed: Oct. 18, 1978

[30] Foreign Application Priority Data

Jan. 18, 1978 [DE] Fed. Rep. of Germany ..... 2801976

[51] Int. Cl.[2] ..... F02M 9/00; B05B 1/30

[52] U.S. Cl. ..... 123/462; 123/501; 123/364; 239/533.8

[58] Field of Search ..... 123/140 R, 140 J, 139 AK, 123/139 AT, 139 AQ, 32 JV; 239/533.8, 533.12

[56] References Cited

U.S. PATENT DOCUMENTS

| | | | |
|---|---|---|---|
| 3,416,506 | 12/1968 | Steiger | 123/140 R |
| 3,625,192 | 12/1971 | Dreisin | 123/139 AT |
| 3,796,379 | 3/1974 | Fenne | 239/533.8 |
| 3,943,903 | 3/1978 | Skinner | 123/140 R |
| 3,976,249 | 8/1976 | Jarrett | 239/533.8 |
| 3,997,117 | 12/1976 | Köhler | 239/533.8 |
| 4,006,859 | 2/1977 | Thoma | 239/533.8 |
| 4,077,376 | 3/1978 | Thoma | 123/139 AT |
| 4,092,964 | 6/1978 | Höfer | 123/139 AT |
| 4,136,654 | 1/1979 | Kuike | 123/139 AK |

*Primary Examiner*—Charles J. Myhre
*Assistant Examiner*—Carl S. Miller
*Attorney, Agent, or Firm*—Edwin E. Greigg

[57] ABSTRACT

The invention relates to a fuel injection system provided with a pump and at least one nozzle, in which the fuel quantity which collects by leakage in the spring chamber of the nozzle for the purpose of limiting the speed of the needle as it opens flows out through a throttle valve in a controlled manner. The throttle valve is controlled in accordance with engine characteristics.

4 Claims, 2 Drawing Figures

FUEL INJECTION SYSTEM

BACKGROUND OF THE INVENTION

The invention relates to a fuel injection system comprising a pump which generates injection pressure and at least one fuel injection nozzle having a valve needle associated therewith with the valve needle being arranged to be loaded in the closing direction by means of a closing spring positioned in a chamber and additionally by fuel which leaks along the valve needle into the spring chamber and is dammed up when it flows through an outlet provided in proximity to said chamber. In a known fuel injection system of this design, the pressure in the spring chamber changes in proportion to the quantity of fuel that leaks into it and in proportion to the position of the valve needle. The fuel quantity, for its part, is directly dependent on the period of time during which pressure prevails in the pressure chamber of the fuel injection nozzle. An opening characteristic of the valve needle is striven for by means of a supplementary piston which is hydraulically controlled and acts on the valve needle, where with this opening characteristic the valve needle has a significantly smaller closing force load during starting than at higher rmp. Because of this, the injection times during idling are particularly short and increase as the engine rpm increases. However, short injection durations during idling are not desirable.

OBJECT AND SUMMARY OF THE INVENTION

The fuel injection system in accordance with the invention has the advantage that the injection characteristic can better be adapted to the requirements of the environment. Thus, for example, it is possible to extend the duration of injection at low rpm and during idling, by which means a significant reduction in noise is accomplished. The closing pressure is not increased. In accordance with the invention, interventions are also possible in dependence on the temperature or other important operating characteristics such as load and rpm, for the purpose of improving the noise level of combustion. Any fuel injection apparatus provided with a pump and the usual type of nozzle can serve as the injection system.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
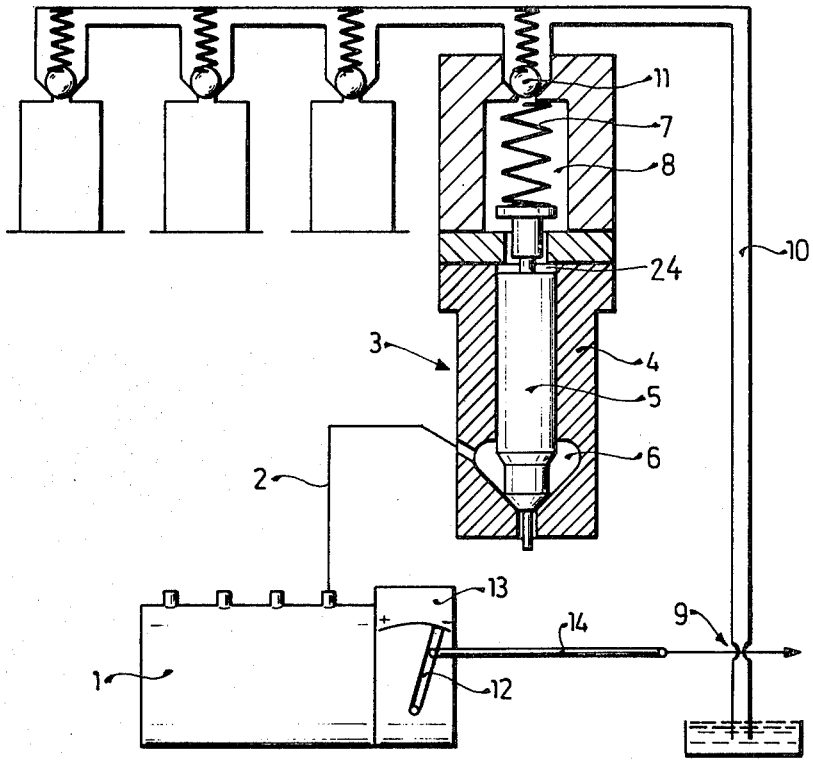
FIG. 1 shows schematically a means for throttle control in accordance with the adjustment lever of the injection pump.

Turning now to FIG. 1, fuel is intermittently supplied by a fuel injection pump 1 via a line 2 to a fuel injection nozzle 3. A valve needle 5 is arranged axially movable within a connecting chamber 24 defined by the nozzle body 4 of the fuel injection nozzle 3. The fuel supplied by the injection pump 1 is directed into the pressure chamber 6 which is defined by the nozzle body 4 and the valve needle 5. When the pressure in the pressure chamber 6 is sufficient, the valve needle 5 is displaced against a closing spring 7 which is arranged within a spring chamber 8 as shown. As long as pressure prevails in the pressure chamber 6, fuel leaks through the connecting chamber 24 between nozzle body 4 and valve needle 5 to the spring chamber 8. This fuel is dammed up by a throttle 9, the diameter of which is variable, with said throttle being provided within a leakage collection line 10 that communicates with the spring chamber 8 of the injection nozzle that forms a part of this injection system. In the example illustrated, there are four injection nozzles and a four-cylinder injection pump, which supply a four-cylinder internal combustion engine, the latter not being shown.

At the outlet of each spring chamber 8 there is arranged a check valve 11 which opens toward the outside and by means of which the leakage line 10 may be isolated, in particular for the purpose of volumetric reduction. By this means the volume located upstream of the throttle, which serves as a standard for the carry-over of the throttling effect, is reduced to a minimum.

The adjustment of the cross-sectional area of the throttle 9 takes place in the embodiment shown in FIG. 1 in accordance with the adjustment lever 12 of the regulator 13 of the fuel injection pump 1. A rod 14, not shown in further detail here, can serve to transfer the amount of adjustment. If, for example, the adjustment lever 12 of the regulator 13 is displaced in the direction of an increasing injection amount, then the throttle 9 is opened wider by the rod 14. At small loads, that is, with a small injection quantity, the throttle is also set at a minimum. By this means it is accomplished that at small load and at low rpm a pressure is built up in the spring chamber 8 through opening the valve needle, which pressure acts counter to a further opening and thus only a small exit cross-section (throttle cross-sectional area) remains open between the nozzle body and the valve needle, with the result that the duration of injection, that is, the length of time the valve needle is lifted from the valve seat in order to allow the supplied fuel to flow through, is relatively long. This lengthening of the duration of injection effects a reduction of the noise of combustion in the engine. Temperature influences or other influences can be made to act on the control of the cross-sectional area of the throttle 9 via the rod 14, in order to reduce combustion noises by these means.

Figure 2:
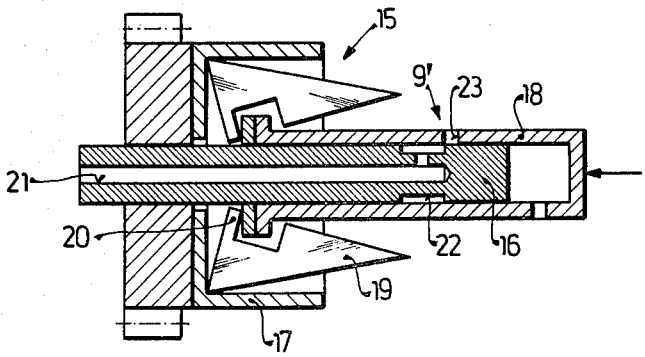
FIG. 2 shows fragmentarily a means for throttle control by the use of a centrifugal governor.

In the exemplary embodiment shown in FIG. 2, the throttle 9' is adjusted by means of a centrifugal adjuster 15, which is associated with the fuel apportionment apparatus in order to set the injection quantity. This centrifugal adjuster 15 can be an rpm adjustment member of a distributor pump; however, it can also be the flyweight control member of an injection adjuster, of a pump nozzle, or of a series pump governor. The centrifugal adjuster has a rigid shaft 16, on which a rotating cup 17 and an adjuster sleeve 18 are fixed at one side. Flyweights 19 which contact the adjuster sleeve 18 via noses 20 are arranged in the rotating cup 17. This rpm-dependent force generated by the flyweights 19 is conventionally countered by a spring force represented by the arrow which is variable in accordance with the load. A bore 21 is arranged within the shaft 16 into which the leakage line 10 empties with the bore being arranged to empty into a radial groove 22 provided in the exterior of the shaft. This radial groove 22 cooperates with a control bore 23 of the adjuster sleeve 18 and thus forms the throttle 9'. Depending upon the extent to which the adjuster sleeve 18 is displaced, the throttle cross-sectional area is larger or smaller.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A fuel injection system comprising:

a fuel pump which generates an injection pressure;

at least two fuel injection nozzles connected to the fuel pump, each of said fuel injection nozzles including: a spring chamber; a pressure chamber to which fuel is delivered under injection pressure by the fuel pump; a connecting chamber extending between and communicating with the pressure chamber and the spring chamber; a valve needle mounted within the pressure chamber and connecting chamber; and a closing spring mounted within the spring chamber for biasing the valve needle into the pressure chamber, wherein fuel flows from said pressure chamber through said connecting chamber around said valve needle and into said spring chamber;

a leakage line connected to the spring chamber;

a check valve connected to the spring chamber and the leakage line for controlling the flow of fuel from the spring chamber into the leakage line; and a common throttle means connected to the leakage lines downstream of the check valves for controlling the pressure in and flow through said leakage lines as a function of engine operating parameters.

2. The fuel injection system as defined in claim 1, wherein the fuel pump includes a fuel quantity control, and wherein the fuel injection system further comprises:

an adjustment lever connected to the throttle means and the fuel quantity control, said adjustment lever serving to adjust the throttle means and thus the pressure in and flow through said leakage lines under the influence of the fuel quantity control.

3. The fuel injection system as defined in claim 1, further comprising:

a centrifugal adjuster including: a shaft defining a bore which communicates with said leakage lines; and a control sleeve axially displaceable on said shaft which defines a control bore which communicates to a greater or lesser extent, as a function of engine load, with the bore defined by said shaft, said control bore serving as said throttle means.

4. The fuel injection system as defined in claim 1, further comprising:

a centrifugal adjuster including: a shaft defining a bore which communicates with said leakage lines; and a control sleeve axially displaceable on said shaft which defines a control bore which communicates to a greater or lesser extent, as a function of engine rpm, with the bore defined by said shaft, said control bore serving as said throttle means.

* * * * *